US005209289A

United States Patent [19]

Haushalter

[11] Patent Number: 5,209,289

[45] Date of Patent: May 11, 1993

[54] LANCED RUFFLED TURBULIZER

[75] Inventor: Frederick W. Haushalter, Kenton, Ohio

[73] Assignee: Robinson Fin Machines, Inc., Kenton, Ohio

[21] Appl. No.: 801,532

[22] Filed: Dec. 2, 1991

[51] Int. Cl.[5] ..... F28F 13/12

[52] U.S. Cl. ..... 165/109.1; 165/152; 165/166

[58] Field of Search ..... 165/109.1, 153, 152, 165/183, 166; 261/112.2, 156

[56] References Cited

U.S. PATENT DOCUMENTS

| | | | |
|---|---|---|---|
| 2,647,731 | 8/1953 | Ludlow | 165/165 |
| 2,990,163 | 6/1961 | Farrell | 165/109.1 |
| 3,768,149 | 10/1973 | Swaney, Jr. | 165/166 |
| 3,983,932 | 10/1976 | Yamaguchi et al. | 165/152 |
| 4,282,927 | 8/1981 | Simmons | 165/166 |
| 4,623,019 | 11/1986 | Wiard | 165/166 |
| 4,815,532 | 3/1989 | Sasaki et al. | 165/152 |

FOREIGN PATENT DOCUMENTS

| | | | |
|---|---|---|---|
| 656654 | 1/1963 | Canada | 165/51 |

*Primary Examiner*—John Rivell
*Assistant Examiner*—L. R. Leo

[57] ABSTRACT

A heat exchanger combines a lanced fin surface with a ruffled fin surface to create a lanced ruffled turbulizer. The lanced ruffled turbulizer combines the turbulence generated by lancing the heat transfer or turbulizer surface to the deflection forces on the fluid stream generated by a ruffled turbulizer to improve the thermal performance of the heat exchanger.

14 Claims, 2 Drawing Sheets

LANCED RUFFLED TURBULIZER

BACKGROUND OF THE INVENTION

The present invention relates to heat exchangers, and, more particularly, to the combination of two different fin surfaces to improve the thermal performance of a heat exchanger.

Heat exchangers are widely used for absorptive thermal protection. To achieve this, heat exchangers are made of various types of corrugated fin material to allow energy transfer during passage of air and fluid through the exchanger. However, a boundary layer of fluid thickness adheres to the heat exchanger or turbulizer, reducing the effectiveness of energy movement from one fluid to another, where a turbulizer is an enhancement made to the surface of the heat exchanger to effectively change the flow characteristic of the fluids.

The type of fin used for heat exchangers or turbulizers is usually dependent on a variety of factors. For example, lanced fin is used when volume available is at a premium. Lanced fin heat exchangers are compact and are capable of breaking up the boundary layer very well. However, one problem with using a lanced turbulizer is that the lanced turbulizer has a very short length before interruption, thereby increasing the pumping energy necessary to transfer a unit of energy.

Alternatively, ruffled fin may be used when volume of space is not the most critical consideration. Ruffled fin turbulizers can achieve the same thermal performance as lanced fin turbulizers, but with lower energy consumption per unit of energy transferred. However, a problem with using standard ruffled fin is that ruffled fin has a very long surface which builds thick fluid films, thereby decreasing its effectiveness to transfer heat.

It is seen then that there exists a need for a heat exchanger which has the short length effectiveness advantage of lanced fin, and the mixing advantage of ruffled fin, while overcoming the disadvantages of each.

SUMMARY OF THE INVENTION

This need is met by the turbulizer according to the present invention, wherein a lanced turbulizer fin surface pattern is combined with a ruffled turbulizer fin surface pattern and used as a heat exchanger disposed between two fluids. The combination of the two different fin surfaces improves the thermal performance of the heat exchanger at a reduced energy requirement as compared to a standard lanced fin, and a reduced volume of space requirement as compared to a standard ruffled fin, while still achieving a thermal performance at least equal to the thermal performance of either a standard lanced or a standard ruffled fin. The turbulizer of the present invention adds the turbulence generated by lancing the heat transfer or turbulizer surface to the deflection forces on the fluid stream generated by a ruffled turbulizer.

In accordance with one aspect of the present invention, a turbulizer comprises a plurality of connecting interposing lines of fin forming a corrugated pattern and generated from a flat sheet of metal. The plurality of connecting interposing lines of fin define a repeating corrugated pattern including, a first section approximately parallel to a horizontal and situated in a horizontal plane, a second section lying in the same horizontal plane as the first section and separated from the first section on one side by a third section and on the other side by a fourth section. The third section slopes downward at a first angle from a first top corner of the second section toward a first bottom corner of the first section, and the fourth section slopes upward at a second angle from a second bottom corner of the first section toward a second top corner of the second section. The repeating corrugated pattern defines a lanced ruffled fin surface and is situated in the order of the first section, the fourth section, the second section, the third section, which order repeats across the fin surface.

The present invention also includes a method for creating a turbulizer, the method comprising the steps of generating a plurality of connecting interposing lines of fin having a surface, and simultaneously lancing and ruffling the plurality of connecting interposing lines of fin to define a repeating corrugated pattern. The corrugated pattern repeats in the order described above.

Accordingly, it is an object of the present invention to provide an improvement in the thermal performance of a heat exchanger. It is also an object of the present invention to provide such an improvement wherein the volume of space required for the heat exchanger is reduced, as compared to a standard lanced fin turbulizer, without sacrificing the thermal performance. It is a further object to provide such an improvement with a reduced power consumption and pressure loss, thereby requiring less energy to exchange the same number of energy units between two fluids, as compared to using a standard ruffled or lanced fin. Finally, it is an object of the present invention to provide such an improvement which combines the effectiveness of the short length of lanced fin to the mixing achieved by ruffled fin.

Other objects and advantages of the invention will be apparent from the following description, the accompanying drawings and the appended claims.

DETAILED DESCRIPTION OF THE PREFERRED EMBODIMENTS

The present invention provides for a combination lanced ruffled turbulizer. The combination of two different fin surfaces combines the advantages of both fin types while overcoming the disadvantages of each standard fin type used alone. The lanced ruffled turbulizer of the present invention requires less energy than standard lanced fin and can be used in an area of smaller volume than a standard ruffled fin, while still exchanging the same number of energy units between the two fluids as the standard lanced fin and standard ruffled fin. In the present invention, the turbulence generated by lancing the heat transfer or turbulizer surface is combined with the deflection forces on the fluid stream generated by a ruffled turbulizer to improve the performance of the heat exchanger.

Figure 1:
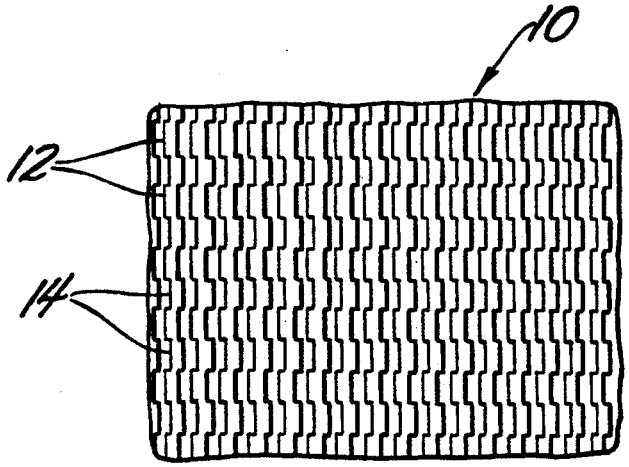
PRIOR ART Fig. 1
FIG. 1 is a top view of a prior art standard lanced fin.

Referring now to the drawings, in FIG. 1 there is illustrated a top view of a prior art lanced fin 10, having a first section 12 offset from a second section 14, to create a square wave type of pattern. As can be seen in FIG. 1, the lanced turbulizer 10 has a very short length 12 before interruption, thereby reducing the effectiveness of the lanced turbulizer due to the high energy usage to facilitate the flow of energy from one fluid to the other.

Figure 2:
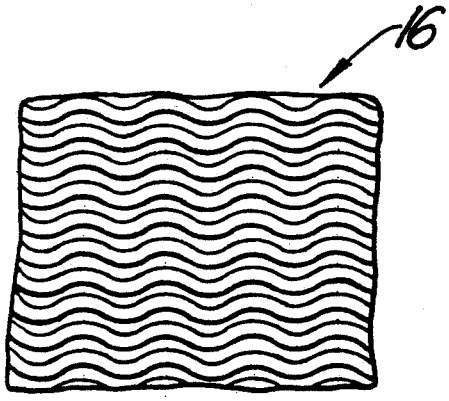
PRIOR ART Fig. 2
FIG. 2 is a top view of a prior art standard ruffled fin.

In FIG. 2, there is illustrated a top view of a prior art ruffled fin 16. The ruffled fin 16 has a sinusoidal type of corrugated pattern without the interruption seen in the lanced fin of FIG. 1. While this provides improved efficiency and energy usage per unit of heat transferred as compared to the lanced fin of FIG. 1, the uninterrupted surface tends to permit fluid film build-up resulting in decreased heat transfer per unit of volume.

Figure 3:
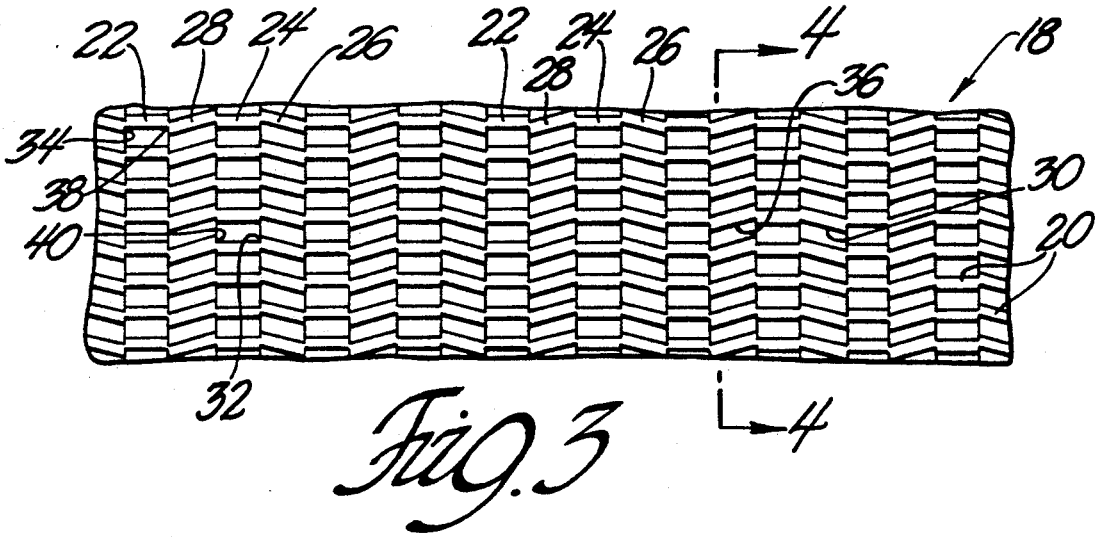
FIG. 3 is a top view of the lanced ruffled turbulizer of the present invention.
Figure 4:
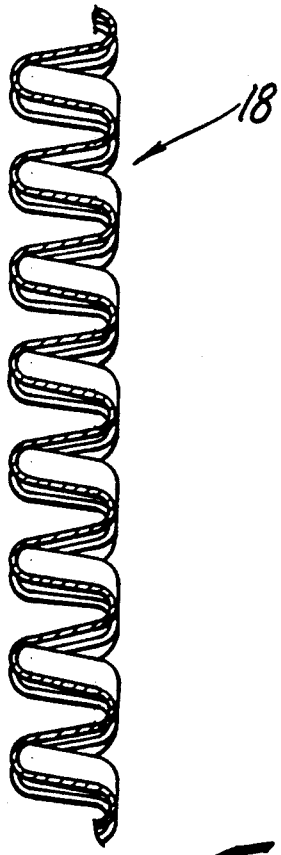
FIG. 4 is a side view of the lanced ruffled turbulizer taken along line 4—4 of FIG. 3.

Referring now to FIGS. 3 and 4, a top view and a side view, respectively, of a lanced ruffled turbulizer 18 of the present invention are illustrated. In FIG. 3, the turbulizer 18 has a plurality of connecting interposing lines of fin 20, forming a repeating corrugated pattern defining the lanced ruffled turbulizer 18. The repeating corrugated pattern includes a first section 22 approximately parallel to a horizontal and situated in a horizontal plane, a second section 24 lying in the same horizontal plane as the first section. A third section 26 is situated such that it separates the second section 24 from a successive occurrence of the first section 22. Also, a fourth section 28 is situated between the first section 22 and the second section 24.

Continuing with FIG. 3, the third section 26 slopes downward at a first angle 30, typically between 5 and 45 degrees, from a first top corner 32 of the second section 24 toward a first bottom corner 34 of the first section 22. Similarly, the fourth section 28 slopes upward at a second angle 36, similar in range to the first angle 30, from a second bottom corner 38 of the first section 22 toward a second top corner 40 of the second section 24. The sections 22, 24, 26, and 28, repeat across the top surface of the turbulizer 18 in the order of third section 26, followed by first section 22, followed by fourth section 28, followed by second section 24. Sections 26 and 28 substantially define the ruffled portion of the lanced ruffled turbulizer 18, while having sections 26 and 28 partially offset from sections 22 and 24 substantially defines the lanced portion of the lanced ruffled turbulizer 18.

The sloping angles 30 and 36 of sections 26 and 28 of the lanced ruffled turbulizer 18 provide an advantage in that they imitate the ruffled fin 16 of FIG. 2 by encouraging fluid flow at a lower energy consumption than the standard lanced fin 10 of FIG. 1. Additionally, the offset between each of the sections 22, 24, 26, and 28 imitate the lanced fin of FIG. 1 by overcoming the disadvantage of fluid film build-up that occurs with the ruffled fin 16 of FIG. 2. Hence, the lanced ruffled turbulizer 18 combines the advantages of lanced fin with the advantages of ruffled fin, while overcoming disadvantages of both the lanced fin and the ruffled fin. This results in an improved fin surface which blends the turbulence generated by lancing a turbulizer surface with the deflection forces on the fluid stream generated by a ruffled turbulizer.

As stated above, the present invention combines the turbulence generated by lancing the heat transfer or turbulizer surface with the deflection forces on the fluid stream generated by a ruffled turbulizer. By combining the lanced fin and the ruffled fin, the fluid mixing that is achieved in the ruffled fin is added to the effectiveness of the short length of the lanced fin prior to interruption, providing improved performance with minimal power consumption.

Having described the invention in detail and by reference to the preferred embodiment thereof, it will be apparent that other modifications and variations are possible without departing from the scope of the invention defined in the appended claims.

What is claimed is:

1. A turbulizer comprising:

a plurality of connecting interposing lines of fin forming a corrugated pattern and generated from a flat sheet of metal, said plurality of connecting interposing lines of fin defining a repeating corrugated pattern including, a first section approximately parallel to a horizontal and situated in a horizontal plane, a section approximately parallel to said horizontal and lying in said horizontal plane, a third section sloping downward at a first angle from a first top corner of said second section toward a first bottom corner of a successive occurrence of said first section, and a fourth section sloping upward at a second angle from a second bottom corner of said first section toward a second top corner of said second section.

2. A turbulizer as claimed in claim 1 wherein said first angle and said second angle are substantially equal.

3. A turbulizer as claimed in claim 1 wherein said repeating corrugated pattern defines a lanced ruffled fin surface.

4. A turbulizer as claimed in claim 1 wherein said third and fourth sections are partially offset from said first section.

5. A turbulizer as claimed in claim 1 wherein said third and forth sections are partially offset from said second section.

6. A turbulizer comprising:

a plurality of connecting interposing lines of fin having a surface, and means for simultaneously lancing and ruffling said plurality of connecting interposing lines of fin to define a repeating corrugated pattern.

7. A turbulizer as claimed in claim 6 wherein said means for simultaneously lancing and ruffling said fin surface comprises tooling.

8. A turbulizer as claimed in claim 6 wherein said repeating corrugated pattern comprises a lanced ruffled fin surface.

9. A method for creating a turbulizer comprising the steps of:

generating a continuous length of fin from a flat sheet of metal, said fin having a surface and further having a plurality of connecting interposing lines of fin; and defining a repeating corrugated pattern on said surface including, a first section approximately parallel to a horizontal and situated in a horizontal plane, a second section approximately parallel to said horizontal and lying in said horizontal plane, a third section sloping downward at a first angle from a top corner of said second section toward a bottom corner of said first section, and a fourth section sloping upward at a second angle from said bottom corner of said first section toward a top corner of said second section.

10. A method as claimed in claim 9 wherein said first angle and said second angle are substantially equal.

11. A method as claimed in claim 9 wherein said repeating corrugated pattern defines a lanced ruffled fin surface.

12. A method as claimed in claim 9 wherein said third and fourth sections are partially offset from said first section.

13. A method as claimed in claim 9 wherein said third and fourth sections are partially offset from said second section.

14. A method for creating a turbulizer comprising the steps of:

generating a plurality of connecting interposing lines of fin having a surface, a nd simultaneously lancing and ruffling said plurality of connecting interposing lines of fin to define a repeating corrugated pattern by, forming a first section approximately parallel to a horizontal and situated in a horizontal plane;

forming a second section approximately parallel to said horizontal and lying in said horizontal plane;

forming a third section sloping downward at a first angle from a first top corner of said second section toward a first bottom corner of said first section; and forming a fourth section sloping upward at a second angle from a second bottom corner of said first section toward a second top corner of said second section.

* * * * *